US005519173A

United States Patent [19]

Newmoyer et al.

[11] Patent Number: 5,519,173

[45] Date of Patent: May 21, 1996

[54] HIGH SPEED TELECOMMUNICATION CABLE

[75] Inventors: Kerry Newmoyer, Denver; Eric Lawrence, Terre Hill, both of Pa.

[73] Assignee: Berk-Tek, Inc., New Holland, Pa.

[21] Appl. No.: 268,843

[22] Filed: Jun. 30, 1994

[51] Int. Cl.[6] ..... H01B 11/02

[52] U.S. Cl. ..... 174/113 R; 156/51; 156/55; 174/27; 174/34; 174/113 C

[58] Field of Search ..... 174/34, 113 R, 174/113 C, 116, 27, 28; 156/51, 55

[56] References Cited

U.S. PATENT DOCUMENTS

| | | | |
|---|---|---|---|
| 445,234 | 1/1891 | Reilly . | |
| 473,267 | 4/1892 | Sawyer . | |
| 1,305,247 | 6/1919 | Beaver et al. . | |
| 1,856,204 | 5/1932 | Affel et al. . | |
| 1,978,419 | 10/1934 | Dudley . | |
| 2,014,214 | 9/1935 | Smith | 174/34 |
| 2,488,211 | 11/1949 | Lemon | 174/28 |
| 2,761,893 | 9/1956 | Morrison | 174/116 |
| 2,804,494 | 4/1957 | Fenton | 174/28 |
| 3,209,064 | 9/1965 | Cutler | 174/36 |
| 3,227,801 | 1/1966 | Demmel | 174/34 |
| 3,489,844 | 1/1970 | Motley | 174/32 |
| 3,644,659 | 2/1972 | Campbell | 174/116 |
| 3,678,177 | 7/1972 | Lawrenson | 174/116 |
| 3,894,172 | 7/1975 | Jachimowicz et al. | 174/34 |
| 4,538,022 | 8/1985 | Barnicol-Ottler et al. | 174/113 R |
| 4,767,890 | 8/1988 | Magnan | 174/113 C |
| 4,873,393 | 10/1989 | Friesen et al. | 174/34 |
| 5,149,915 | 9/1992 | Brunker et al. | 174/36 |

FOREIGN PATENT DOCUMENTS

| | | |
|---|---|---|
| 7807175 | 1/1980 | Netherlands . |

*Primary Examiner*—Morris H. Nimmo
*Attorney, Agent, or Firm*—Ware, Fressola, Van Der Sluys & Adolphson

[57] ABSTRACT

A high speed telecommunication cable includes at least one filler member having a plurality of twisted pair conductors disposed about the periphery thereof. Preferably, a plurality of twisted pair conductors are helically wound about each of two filler members and form a single layer about each filler member.

13 Claims, 2 Drawing Sheets

HIGH SPEED TELECOMMUNICATION CABLE

BACKGROUND OF THE INVENTION

The present invention generally relates to a high frequency, high performance telecommunication cable for commercial building applications and, in particular, relates to one such high frequency telecommunication cable including a plurality of twisted pair conductors disposed about a support means.

Historically, early telecommunication cable designs have suffered from the dynamic, inductive effects of parallel and adjacent conductors. Also generally known as "crosstalk", this problem becomes even more severe at high frequencies or high data rates and over long distances. Thus, crosstalk effectively limits the frequency range, bit rate, cable length, signal to noise ratio as well as the number of conductor pairs which can be used within a single cable for signal transmission. Further, the higher the number of potentially "energized" conductors or pairs there are in the cable, the more potential exists for crosstalk interference. Crosstalk can be even more pronounced in bi-directional transmission cables. Generally known as "near end crosstalk", the effect is particularly noticeable at either end of the cable where signals returning from the opposite end are weak and easily masked by interference. It quickly became known in the art that crosstalk could be better controlled by separating parallel and adjacent transmission lines or by transposing the signals along the cable to minimize the proximity of any two signals. For example, U.S. Pat. No. 445,234 issued to Reilly on Jan. 27, 1891, discloses a single conductor arrangement where signals are transposed at various locations along the length of cable so that no two conductors would occupy the same relative positions. Although physically separating conductors Sufficiently to limit crosstalk in a single, compact cable proved difficult, several such designs emerged. For example, U.S. Pat. No. 473,267, issued to Sawyer on Apr. 19, 1892, describes a technique for braiding single conductors to maintain spacing among adjacent conductors and thereby reduce capacitance and reduce strain. Similarly, U.S. Pat. No. 1,305,247, issued to Beaver, et at. on Jun. 3, 1919, describes the use of a rubber insulator between two conductors for adding elasticity without damaging the conductors. Subsequent designs, such as that disclosed in U.S. Pat. No. 1,856,204, issued to Affel, et al. on May 24, 1930, described conductor arrangements for providing spare conductors for special services. Nevertheless, the problem of crosstalk remained a major problem for cable makers and users.

As a result, efforts to reduce crosstalk between adjacent conductors or pairs continued. For example, U.S. Pat. No. 1,978,419, issued to Dudley on Oct. 30, 1934, discloses the use of bundled coaxial conductors for supporting hi-directional transmission of signals having similar frequencies while minimizing near end crosstalk. However, coaxial cables tend to be quite large, particularly for large numbers of conductors. Still other techniques were used to achieve improved cable performance such as the use of heavy gauge conductors and special twining or twisting techniques as disclosed in the U.S. Pat. No. 2,014,214, issued to Smith on Sep. 10, 1935.

Spacers or fillers have been used as part of cable configurations for maintaining spacing of conductors. For example, U.S. Pat. No. 2,488,211, issued to Lemon on Nov. 15, 1949, discusses and describes the use of a filler arranged around a central multi-strand conductor for maintaining separation between the central conductor and a surrounding metallic screen in a high frequency cable. Further, U.S. Pat. No. 2,761,893, issued to Morrison on Sep. 4, 1956, discusses the use of a central filler made of fibrous jute in a travelling electrical cable to provide enhanced mechanical balance.

In addition to incorporating various fillers in cables to enhance electrical characteristics, special routing of conductors inside a cable has been used to reduce crosstalk. In particular, U.S. Pat. No. 3,227,801, issued to Demmel on Jul. 4, 1966, describes the technique of using a precise conductor crossing method whereby the distance over which any two conductors are adjacent is minimized.

In addition, various dielectric materials have been used inside cables to enhance electrical characteristics. For example, in U.S. Pat. No. 2,804,494, issued to Fenton on Apr. 8, 1953, conductors of a high frequency transmission line are separated by air, acting as a dielectric, to reduce noise pickup. However, it should be noted that Fenton addresses the problem of external interference and not crosstalk between adjacent conductors within the same cable.

Still other techniques have been employed for maintaining a particular conductor geometry. For example, in U.S. Pat. No. 3,644,659, issued to Campbell on Feb. 22, 1972, resilient filler strings are used as a central core to hold a surrounding layer of conductors against an outer shield. The objective in Campbell's cable is to maintain firm contact between the conductors and the outer shield, even while being flexed, for maintaining high impedance. Similarly, U.S. Pat. No. 3,678,177, issued to Lawrenson on Jul. 18, 1972, also describes the use of a central filler surrounded by conductor pairs all contained within an outer shield. Therein, Lawrenson discusses the use of dielectric spacers between pairs of conductors rather than the use of tightly twisted pairs. U.S. Pat. No. 4,767,890, issued to Magnan on Aug. 30, 1988, also discusses the use of a central filler, around which conductors are arranged for reducing the "skin effect" across the audio frequency range.

Conventional high frequency telecommunication cable configurations generally employ unshielded twisted pairs (UTP) as the primary cable component. Although many configurations are used in the industry, typical configurations include four twisted pairs and are performance rated by impedance, attenuation and near end crosstalk.

Contemporary commercial building cabling standards facilitate planning and installation of cabling by establishing performance and technical requirements for various system configurations. The most rigid of these standards define specifications for cabling intended to support a broad range of telecommunication services including voice, data, video, and the like.

More recently, the rapid growth in telecommunications, and in particular local area networks, has sparked an increase in demand for high capacity, high performance, high frequency telecommunications cable. To meet this demand, contemporary cable configurations incorporate higher pair counts to make more efficient use of cable space. However, recent industry standards for cables with higher pair counts are more rigorous than standards for lower pair count, such as 4 pair cables. Most significantly, the crosstalk requirement changes from a worst pair requirement to a power sum type requirement which is more far difficult to attain.

Specifically, unlike the traditional Near End Crosstalk (NEXT) standard which identifies and quantifies the worst pair-to-pair combination in the cable, the Power Sum Near End Crosstalk (PSNEXT) standard of a specific pair is the mathematical pair-to-pair near end crosstalk contributions of all other pairs in the cable into that pair. Consequently, PSNEXT determines each twisted pair's resistance to coupled power from all other pairs, summed on a power basis, when all the pairs are simultaneously energized. Such a stringent standard is now used in a network environment where multiple high frequency or high data rate transmissions are employed in a single cable, as can be seen when the cable is used as a backbone for a network, or networks, as part of a structured cabling system.

It is well known in the art that the factors most affecting near end crosstalk are resistive or inductive unbalances, distance between the disturbing and disturbed (or listening) pairs and careful lay length selection. However, even with this knowledge, cable configurations with large twisted pair counts, typically greater than four have been unable to meet the requisite PSNEXT requirements. Alternative approaches such as bundled four pair cables, each with its own jacket with or without an overall jacket, tend to be difficult to manage and install.

Consequently, a high speed, high performance telecommunications cable having a higher twisted pair count while maintaining superior power sum crosstalk performance is highly desirable.

SUMMARY OF THE INVENTION

Accordingly, it is one object of the present invention to provide a high speed, high performance telecommunication cable with a large twisted pair conductor count and superior power sum near end crosstalk performance.

The foregoing object is accomplished, at least in part, by a high speed, high performance telecommunication cable wherein a plurality of twisted pair conductors are selectively spaced and helically wound around a support means within the cable jacket.

In one aspect of the present invention, the arrangement of the twisted pair conductors on the support means is such that the proximity of any given twisted pair conductor to other twisted pair conductors is minimized. By use of the support means, the average distance or separation, between pairs is increased which reduces the various pair-to-pair couplings which, in turn, reduces the PSNEXT. This separation technique maximizes the number of pairs whose contribution to the power sum crosstalk for any given pair is not significant. Thus, with fewer significant power sum contributors, pair position and lay length selection is less critical, yielding excellent power sum crosstalk performance combined with an insensitivity to manufacturing variation in dimensions, twist frequency or geometrical positioning.

Adjacent, and near adjacent (neighbor), pairs are the worst power sum contributors for any given pair due to their close proximity. By use of the support means, the number of adjacent and near adjacent pairs for any given pair is reduced, thus reducing the number of significant power sum contributors, resulting in improved power sum crosstalk performance. In addition, the lay length of a given twisted pair conductor is selected so as to be different than adjacent twisted pair conductors to reduce crosstalk. Although a repeating pattern of pair lay lengths can be used, it does not affect the PSNEXT performance since the pairs with the repeated lay lengths are designed as to be insignificant power sum contributors. As used herein the phrase "lay length" and the idiomatic variations thereof refers to the distance between successive crossover points in a twisted pair conductor. Lay length is often thought of as twists per foot or per inch. For example, a pair with a 1 inch lay length represents 12 twists per foot.

The high frequency telecommunication cable of the present invention offers several advantages in addition to providing a superior power sum near end crosstalk performance. For example, the configuration allows the cable to be flexed without damaging the physical spacing of the twisted pair conductors. As a result, the superior electrical performance of this cable is maintained regardless of the run path of the cable or excessive installation stresses to maintain exceptional link performance. Also, the design has been found to be readily integrated with conventional industry connectors. Furthermore, the present high speed telecommunication cable is relatively easy to manufacture and is less sensitive to manufacturing variation due, in part, to the extreme margin of the crosstalk against the requirements of the existing published and draft industry standards. Typically, a pair is surrounded by many other twisted pairs such that a single error in pair lay length or other factor like capacitance unbalance may render the cable unsatisfactory. Other techniques are used to limit the extent to which a pair is in proximity to any other given pair but may require excessive manufacturing time an cost due to multiple cabling/twining operations and generally tighter pair lay lengths.

Other objects and advantages will become apparent to those skilled in the art from the following detailed description read in conjunction with the appended claims and drawings attached hereto.

BRIEF DESCRIPTION OF THE DRAWINGS

The drawings, not drawn to scale, include.

DETAILED DESCRIPTION OF THE INVENTION

Figure 1:
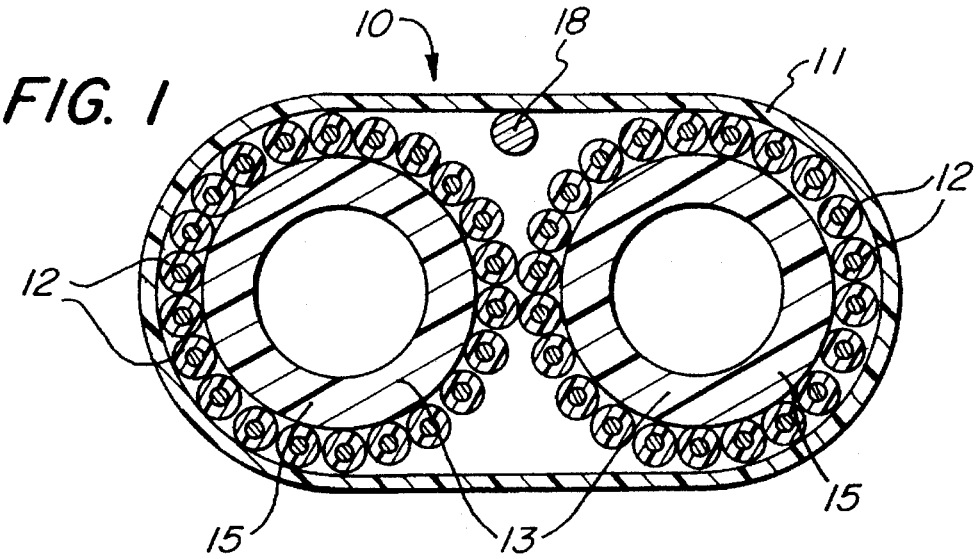
FIG. 1 which is a cross-sectional end view of a high frequency telecommunication cable embodying the principles of the present invention.

A high frequency telecommunication cable, generally indicated at 10 in FIG. 1 and embodying the principles of the present invention, includes a jacket 11, a plurality of twisted pair conductors 12 disposed within the jacket 11 and support means 13 within the jacket 11 for supporting the twisted pair conductors 12, the plurality of twisted pair conductors 12 being disposed about the support means 13.

Figure 4:
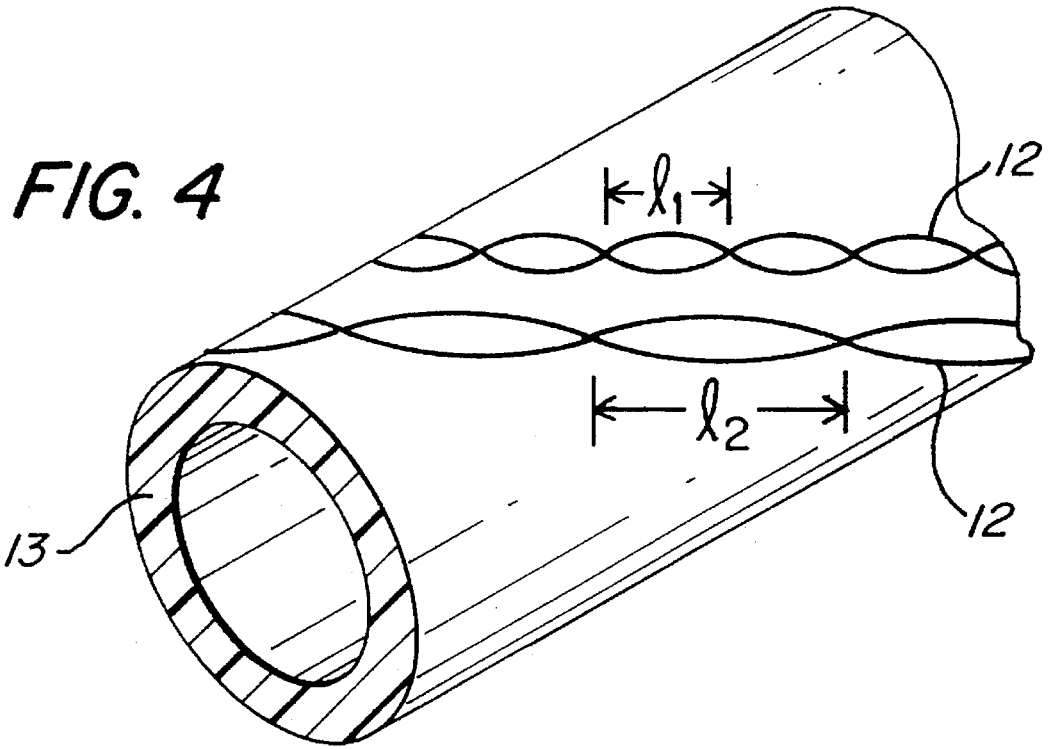
FIG. 4 which is a perspective view, shown without the jacket, of one of the filler members of the high frequency telecommunication cable shown in FIG.

In one preferred embodiment, the high frequency telecommunication cable 10, the twisted pair conductors 12 of the high frequency telecommunication cable 10 are helically wound around the support means 13. Further, as shown in FIG. 4, the lay lengths $\mathbf{l_1}$ and $\mathbf{l_2}$ of each adjacent twisted pair conductors, are not equal. Preferably, the lay lengths of the twisted pair conductors within the cable 10 have a minimum length of about 0.45 inch and a maximum length of about 1.0 inch. The direction of lay of the twisted pair conductors 12 or helical winding about the support means 13 may be left hand or right hand. Pitch about the helical winding can preferably range from about 6 inches to 10 inches and is not equal to prevent multiple contact of the pairs 12 with the same lay length from one winding to the other, thus reducing crosstalk coupling. The selection of adjacent twisted pair conductors 12 in this manner acts to reduce crosstalk therebetween.

In one preferred embodiment, the jacket 11 is made of a flexible electrically insulating material, such as, for example, a fluropolymer, PVC, or a polymer alloy. Preferably, the cable 10 also includes a rip cord 18 disposed under the jacket for separating the jacket and allowing a portion of the jacket 11 to be removed. Such removal is typically required for connecting the twisted pair conductors 12 to end connectors (net shown) or otherwise terminating the cable.

Figure 2:
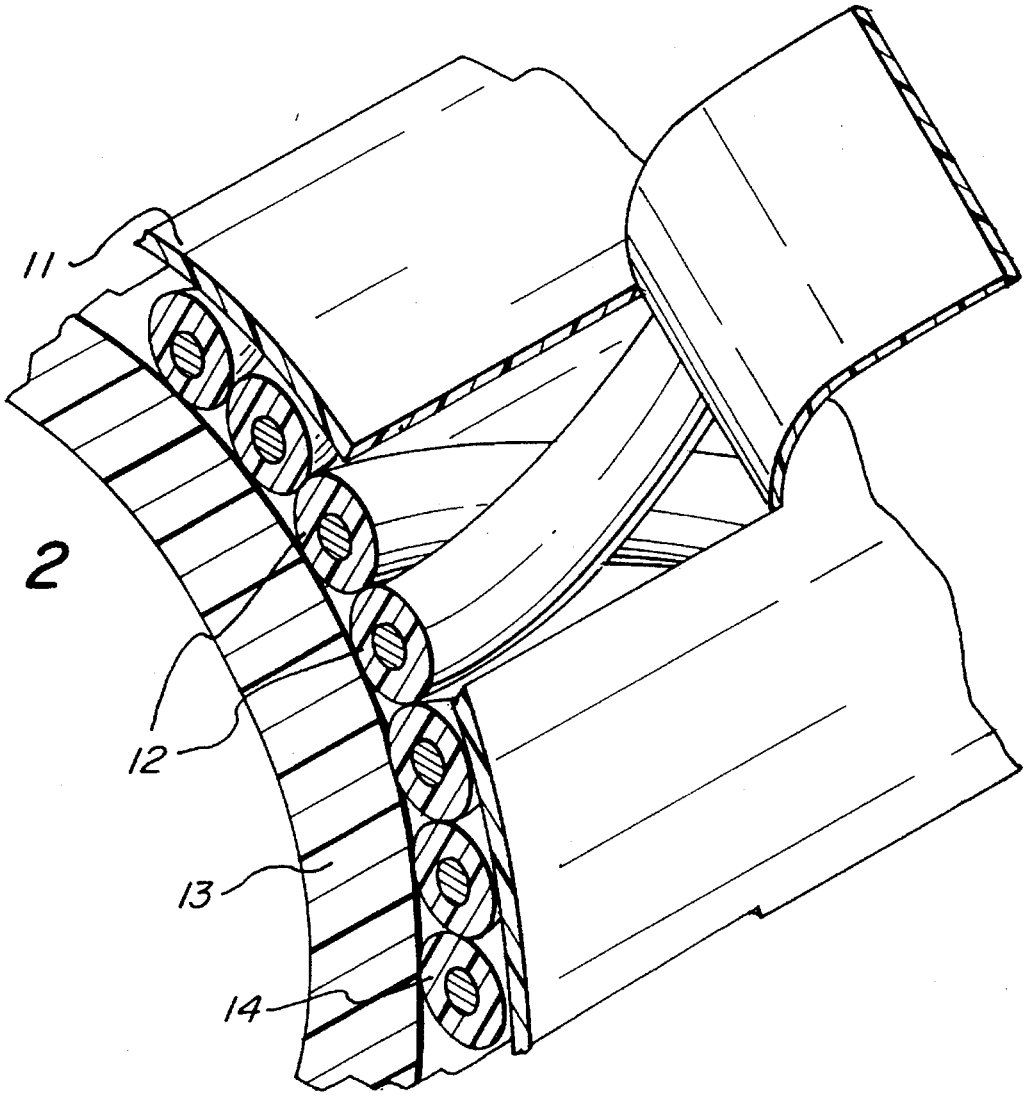
FIG. 2 which is a perspective end view, including a cut away portion, of the high frequency telecommunication cable shown in FIG. 1.

Each of the twisted pair conductors 12 is, as more clearly shown in FIG. 2, provided with an insulating layer 14. Typically, the insulating layer 14 is a plastic material, such as, for example, polyolefin, flame retardant polyolefin, fluropolymer, PVC, or a polymer alloy.

In the embodiments shown, the plurality of twisted pair conductors 12 are disposed about the support means 13. In the preferred embodiment, the twisted pair conductors 12 are arranged in a single layer about the support means 13. As a result, the number of adjacent twisted pair conductors 12 is minimized.

This arrangement, when combined with selected lay lengths as described above, results in substantially reduced crosstalk between twisted pair conductors 12. Even in the preferred embodiment where the support means 13 includes multiple filler members 15, the twisted pair conductors 12 located between the filler members 15 are typically directly adjacent to only about five other twisted pair conductors 12.

In one embodiment, the support means 13 within the jacket 11 for supporting the plurality of twisted pair conductors includes one or more filler members 15. Although any number of filler members 15 can be included, the preferred embodiment includes two filler members 15. As shown in FIG. 1, the twisted pair conductors 12 are then separated into two groups and each group is disposed around one of the filler members 15. Preferably, the filler members 15 are sized so that when the desired number of twisted pair conductors 12 are arranged around each filler member 15, the plurality of twisted pair conductors 12 form a single layer on each filler member 15 with no overlap of twisted pair conductors 12. By arranging the twisted pair conductors 12 around the two filler members 15 in this manner, preferably with a varying pitch, the number of twisted pair conductors adjacent to other twisted pair conductors is minimized resulting in reduced crosstalk. In one particular implementation, the plurality of twisted pair conductors 12 are separated into a group of 12 pairs and a group of 13 pairs, each group being wound about one of the filler members 15. Preferably, the filler members 15 are hollow and selected from a material that reduces cable weight, increased flame retardancy and increases flexibility. Typically, the material can be PVC, a fluoropolymer, of a polymer alloy.

As discussed above, in the preferred embodiment as shown in FIG. 1, the plurality of twisted pair conductors 12 are helically wound around the filler members 15. The helical winding of the twisted pair conductors 12 maintains the physical spacing of the twisted pair conductors 12 along the length of the cable 10, even when the cable 10 is flexed. In the preferred embodiment, the helical windings around the filler members 15 are of different pitches. Such an arrangement minimizes the proximity of twisted pair conductors 12 located between the filler members 15 to other twisted pair conductors 12.

Figure 3:
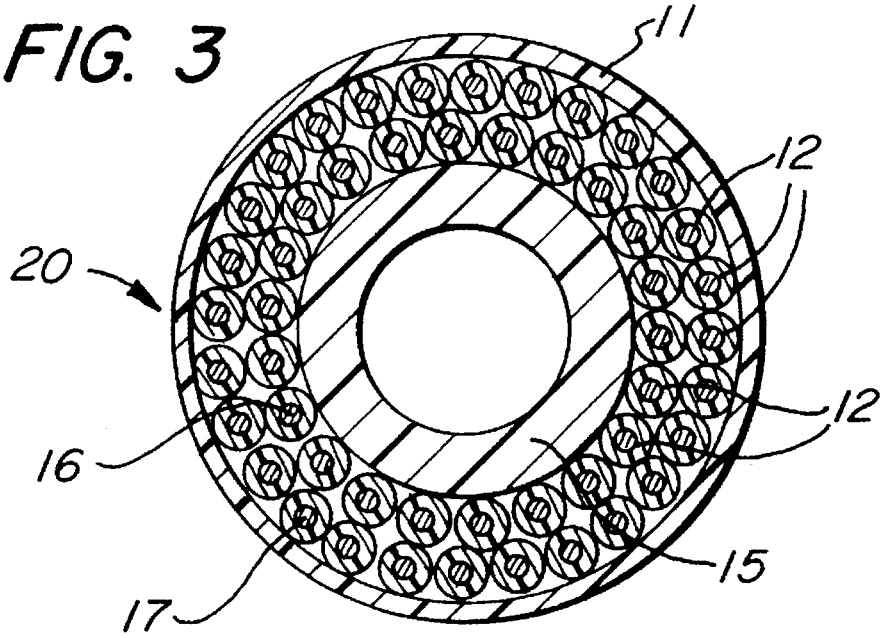
FIG. 3 which is a cross-sectional end view of a second embodiment of a high frequency telecommunication cable also embodying the principles of the present invention.

In an alternative embodiment shown in FIG. 3, the support means 13 includes a single filler member 15. Similar to the embodiment previously described herein, the single filler member 15 supports a plurality of twisted pair conductors 12 disposed around the filler member 15. However, in this embodiment the single filler member includes more than one layer of twisted pair conductors 12. Such an arrangement can be used to support large numbers of twisted pair conductors 12. Hence, in such an embodiment, a first layer 16 of twisted pair conductors 12 is disposed on the filler member 15 and a second layer 17 of twisted pair conductors 12 is disposed on the first layer 16. Typically, the second layer 17 of twisted pair conductors 12 would have a higher number of twisted pair conductors 12 than the first layer 16. For example, the first layer 16 can include 10 pairs and the second layer 17 can include 15 pairs. In addition, the pitch of the helical winding of the second layer 17 of twisted pair conductors 12 can be different and in the opposite direction of the helical winding of the first layer 16 of twisted pair conductors 12. Although this embodiment results in each twisted pair conductor 12 having more adjacent twisted pair conductors 12 than the previously discussed embodiment, an appropriate choice of twisted pair conductor lay lengths combined with precise pair placement as described above still produces a cable having excellent crosstalk performance.

In one specific embodiment of the invention, the jacket is preferably made of fluorocopolymer, having a nominal thickness of 0.015 inches and a nominal diameter of 0.580 inches. The filler members 15 are preferably formed from and have a nominal outside diameter of about 0.2 inch and a wall thickness of about 0.025 inch. In addition, each of the members of the plurality of twisted pair conductors are preferably copper, have a nominal diameter of 0.020 inches with a nominal insulation thickness of 0.007 inches.

As will be appreciated from the description provided herein, the present invention offers several advantages over the prior art. For example, the cable 10 is lightweight and compact while containing a large twisted pair conductor count. Also, the cable 10 is flexible and fire retardant. In addition, the cable 10 is simple to manufacture and is compatible with existing industry standards defining component, installation and cable performance. Most importantly, the physical spacing of the twisted pair conductors 12 around the filler members 15 coupled with different twisted pair conductor lay lengths contribute to a high frequency telecommunication cable 10 having superior electrical performance at transmission frequencies on the order of about 100 $MH_z$ and, in particular, superior power sum near end crosstalk performance. The present invention has been shown to exceed even the most stringent industry performance standards for high twisted pair conductor count cables.

Although the present invention has been described and discussed herein with respect to one or more embodiments, other arrangements or configurations may also be used that do not depart from the spirit and scope hereof. Hence, the present invention is deemed limited only by the appended claims and the reasonable interpretation thereof.

What is claimed is:

1. A high speed telecommunication cable; said cable comprising:

a jacket;

a plurality of twisted pair conductors, said twisted pair conductors being disposed within said jacket; and support means, within said jacket, for supporting said twisted pair conductors, said twisted pair conductors being disposed about said support means, said support means including at least two hollow filler members.

2. The high speed telecommunication cable as claimed in claim 1; wherein the lay length of said plurality of twisted pair conductors is selected such that adjacent twisted pair conductors have different lay lengths.

3. The high speed telecommunication cable as claimed in claim 1; wherein said plurality of twisted pair conductors are helically wound about said support means.

4. The high speed telecommunication cable as claimed in claim 3; wherein the lay length of each of said plurality of twisted pair conductors is selected such that adjacent twisted pair conductors have different lay lengths.

5. The high speed telecommunication cable as claimed in claim 1; wherein said plurality of twisted pair conductors are helically wound about each said filler member, the helical winding having a different pitch and direction than the helical winding about an adjacent filler member,

6. The high speed telecommunication cable as claimed in claim 5; wherein said plurality of twisted pair conductors is a single layer of twisted pair conductors.

7. The high speed telecommunication cable as claimed in claim 6; wherein the lay length of said plurality of twisted pair conductors is selected such that adjacent twisted pair conductors have different lay lengths.

8. The high speed telecommunication cable as claimed in claim 7; wherein said filler members comprises a first filler member and a second filler member.

9. The high speed telecommunication cable as claimed in claim 8; wherein said plurality of twisted pair conductors disposed about said first filler member includes twelve twisted pairs and wherein said plurality of twisted pair conductors disposed about said second filler member includes thirteen twisted pairs.

10. A high speed telecommunication cable; said cable comprising:

a jacket;

a plurality of twisted pair conductors, said twisted pair conductors being disposed within said jacket; and support means, within said jacket, for supporting said twisted pair conductors, said twisted pair conductors being disposed about said support means, said supporting means including one hollow member wherein said plurality of twisted pair conductors form at least one layer of twisted pair conductors about the periphery of said filler member.

11. The high speed telecommunication cable as claimed in claim 10; wherein the lay length of said plurality of twisted pair conductors is selected such that adjacent twisted pair conductors have different lay lengths such that crosstalk is reduced.

12. The high speed telecommunication cable as claimed in claim 11; wherein said plurality of twisted pair conductors further comprises a first layer disposed on said filler member and a second layer disposed on said first layer.

13. The high speed telecommunication cable as claimed in claim 12; wherein said first layer is comprised of ten twisted pair conductors and wherein said second layer is comprised of fifteen twisted pair conductors.

* * * * *